US006952075B2

(12) United States Patent
Sakai et al.

(10) Patent No.: US 6,952,075 B2
(45) Date of Patent: Oct. 4, 2005

(54) COLD CATHODE AND COLD CATHODE DISCHARGE DEVICE

(75) Inventors: Tadashi Sakai, Kanagawa-ken (JP); Tomio Ono, Kanagawa-ken (JP); Naoshi Sakuma, Kanagawa-ken (JP); Zhang Li, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/810,637

(22) Filed: Mar. 29, 2004

(65) Prior Publication Data

US 2004/0178712 A1 Sep. 16, 2004

Related U.S. Application Data

(62) Division of application No. 10/098,571, filed on Mar. 18, 2002, now Pat. No. 6,781,294.

(30) Foreign Application Priority Data

Mar. 29, 2001 (JP) ..... 2001-97416

(51) Int. Cl.[7] ..... H01J 1/05; H01J 1/14

(52) U.S. Cl. ..... 313/311; 313/310; 313/346 R; 313/632; 313/491

(58) Field of Search ..... 313/310, 311, 313/491, 346 R, 631, 632, 640

(56) References Cited

U.S. PATENT DOCUMENTS

| | | | |
|---|---|---|---|
| 5,536,193 | A | 7/1996 | Kumar |
| 5,861,707 | A | 1/1999 | Kumar |
| 5,982,095 | A | 11/1999 | Jin et al. |
| 6,097,139 | A | 8/2000 | Tuck et al. |
| 6,181,056 | B1 | 1/2001 | Yaniv et al. |
| 6,281,626 | B1 | 8/2001 | Nakamura et al. |
| 6,441,550 | B1 | 8/2002 | Patterson et al. |
| 6,534,923 | B2 | 3/2003 | Espinosa |

FOREIGN PATENT DOCUMENTS

| | | |
|---|---|---|
| JP | 4-352362 | 12/1992 |
| JP | 8-236010 | 9/1996 |
| JP | HEI 10-149796 | 6/1998 |
| JP | 10-326591 | 12/1998 |
| JP | 2000-106130 | 4/2000 |
| JP | 2000-285863 | 10/2000 |

*Primary Examiner*—Joseph Williams
*Assistant Examiner*—German Colón
(74) *Attorney, Agent, or Firm*—Oblon, Spivak, McClelland, Maier & Neustadt, P.C.

(57) ABSTRACT

A cold cathode discharge device with high efficiency of light emission and long life is prepared by a cold cathode having both high secondary electron emission and anti-spattering property.

Using carbon system cold cathodes constituted of a mixed phase of diamond and graphite, a cold cathode discharge device with high efficiency of light emission and long life is realized. It is desirable that an element having a wavelength of light emission equal to or shorter than 200 nanometers should be mixed in the discharge gas.

10 Claims, 4 Drawing Sheets

COLD CATHODE AND COLD CATHODE DISCHARGE DEVICE

CROSS-REFERENCE TO RELATED APPLICATIONS

This application is a Divisional of U.S. patent application Ser. No. 10/098,571, filed on Mar. 18, 2002 now U.S. Pat. No. 6,781,294, and is based upon and claims the benefit of priority from the prior Japanese Patent Application No. 2001-97416, filed on Mar. 29, 2001, the entire contents of which are incorporated herein by reference.

BACKGROUND OF THE INVENTION

1. Field of the Invention

This invention relates to a cold cathode and a cold cathode discharge device.

2. Description of the Related Art

A cold cathode discharge device represented by a cold cathode discharge lamp has a simple structure, which does not employ any heating filaments. Accordingly, because the device can easily be miniaturized and operate at a low temperature, and moreover has a relatively long life, it is widely put to use recently for a wide variety of lighting or a backlight of a liquid crystal display device.

On the other hand, because the cold cathode discharge lamp keeps discharging by means of secondary electron emission from the cold cathode due to ion bombardment of the discharge gas filled therein, it is usually required that a bias voltage should be applied near the cathode portion in order to generate a very high electric field compared with a thermal cathode used for a thermal cathode fluorescent lamp, etc. While the lamp is turned on, it is therefore necessary to supply a high voltage thereto, and consequently the cold cathode discharge lamp is inferior to the thermal cathode discharge lamp with regard to the conversion efficiency of electric power into light, because of the high electric field and the high voltage mentioned above. However the cold cathode type lasts longer than the thermal cathode type, so that it is frequently used for some applications where exchanging the lamp is not easy. In consequence, it is desired that durability of the lamp and a discharge device should be much more improved.

BRIEF SUMMARY OF THE INVENTION

Accordingly, the present invention is intended to solve the two problems i.e. light emitting efficiency and life of the cold cathode discharge device, and consequently to realize both higher efficiency of light emission and longer life of the device.

One aspect of the present invention is to obtain a cold cathode comprising a supporting member and an electron emitter supported by the supporting member and having an electron-emitting surface which emits electrons, the electron-emitting surface comprising a mixed phase of diamond phase and conductive carbon phase, and the conductive carbon extending in the form of a channel between the supporting member and the electron-emitting surface in the electron emitter. The cold cathode here means an electrode structure that does not have any heating filaments. Electron emission itself includes secondary electron emission due to ion bombardment, field emission, thermal electron emission caused by self-heat generation, and other emission according to a mechanism of such as thermionic field emission that is between thermal electron emission and field emission.

Furthermore, the diamond phase of the electron emitter preferably includes a donor impurity in this case.

Moreover it is desirable that the diamond phase should be constituted of a granular body, and a graphite or amorphous carbon layer should be formed on a boundary surface of the granular body.

The other aspect of the present invention is further intended to obtain a cold cathode discharge device comprising an envelope filled with a discharge gas therein and a cold cathode provided in the envelope, wherein the cold cathode comprises a supporting member and an electron emitter with an electron-emitting surface to emit electrons supported by the supporting member, the electron emitter comprising a mixed phase of diamond phase and conductive carbon phase, and the discharge gas containing a gas including an element with a principal radiation peak of 200 nanometers or less in wavelength.

Besides, it is desirable for the discharge, gas to include xenon (Xe).

The essence of the present invention is to use a material of carbon system comprising diamond with a negative electron affinity or an electron affinity remarkably smaller than that of electrodes made of such as metal, and a granular boundary layer of graphite or amorphous carbon made of carbon that is the same as the diamond and having sp2 bonding, as an electrode for the cold cathode.

It also is desirable that the diamond should be high quality and has the Fermi-level raised by adding an impurity of donor nature, i.e. phosphor, sulfur, nitrogen, or alkaline metals thereto. Furthermore, the present invention is characterized in that electron-emission in the discharge lamp is preferably promoted by direct excitation due to excited radiation in the discharge lamp, by means of adding Xe, etc. having an excited radiation wavelength with an energy equal to or greater than the band gap of diamond, to the gas filled therein.

The cold cathode according to the present invention employs a carbon system electrode comprising diamond phase and graphite or amorphous carbon layer instead of a metallic electrode of such as nickel (Ni),which is used for conventional cold cathodes. Carbon is contained within the inside of the discharge tube together with mercury, so as to play a role to assist mercury to be excited effectively. Carbon is one of the elements that are the hardest of almost all elements with respect to spattering by argon (Ar) ion bombardment. On the other hand, life of the cold cathode discharge lamp finally depends on wear-off of the electrode by spattering, so that the carbon system material is very effective against such phenomenon.

However secondary electron emission is very small for the graphite system material. Because mechanism of electron emission for the cold cathode discharge lamp is secondary electron emission by ion bombardment of such as Ar filled therein (gamma action), the graphite system material was difficult to be applied actually as an electrode material for the cold cathode, although its anti-spattering property is superior.

The present invention makes efficiency of the secondary electron emission be consistent with the anti-spattering property by combining the diamond with the graphite system, resulting in realization of the cold cathode discharge device that has high efficiency and long life.

DETAILED DESCRIPTION OF THE INVENTION

Referring to some figures hereinafter, embodiments of the present invention will be explained.

Figure 1:
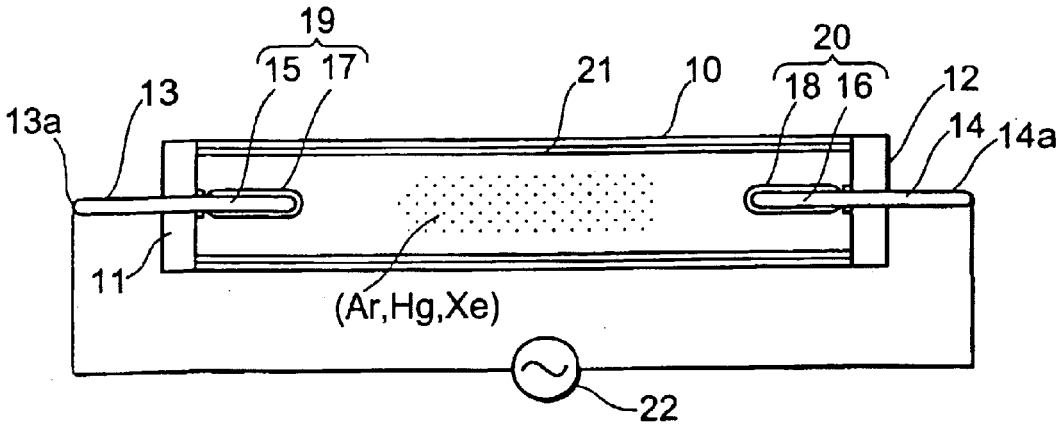
FIG. 1 is a cross section of the first embodiment.
Figure 2:
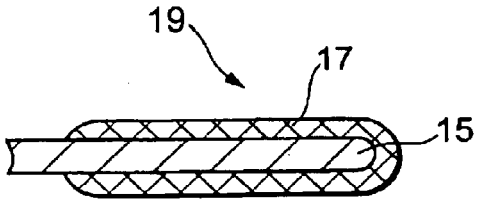
FIG. 2 is a magnification of the main portion of the first embodiment.

FIG. 1 and FIG. 2 show the first embodiment of the present invention, in which both ends of an elongated envelope 10 of transparent glass are formed with stems 11 and 12 where leads 13 and 14 are hermetically sealed respectively. The portions of the leads, which protrude inside the envelope, are cathode-supporting members 15 and 16 of metal such as nickel. Electron emitters 17 and 18 are stuck to the supporting members and constitute cold cathodes 19 and 20 together with the supporting members. A fluorescent film 21 is coated on the inner surface of the envelope, and the envelope is filled with a discharge gas of Ar, Hg and Xe at a low pressure.

Lead portions 13*a* and 14*a* protruding out of the envelope toward the outside are electrode terminals connected to, for example, an AC power source 22. When a voltage is applied thereto, discharge starts in the envelope., one of the electrodes, for example, 17 emitting electrons as a cold cathode and the other electrode, for example, 18 acting as an anode.

The electron emitter 17(or 18) constituting the cold cathode 19(or 20) is comprised of diamond-graphite mixed phase of graphite phase and diamond phase, and coated on the supporting members 15(or 16) as shown in FIG. 2, and thereafter sintered to be fixed thereto. The surface 23*a* thereof is rough, and channels 24 of conductive carbon of graphite phase extend from the surface side to the supporting member 15 inside the diamond phases 23 in the direction of the thickness thereof. Moreover, ends of the channels expose to the surface 23.

The manufacturing method for the above structure includes hardening process of diamond grains of 50 nanometers to 50 micrometers in diameter with a binder of graphite system, and heat-treating process of the hardened diamond grains. The method can produce the electrode at a low price.

Figure 3:
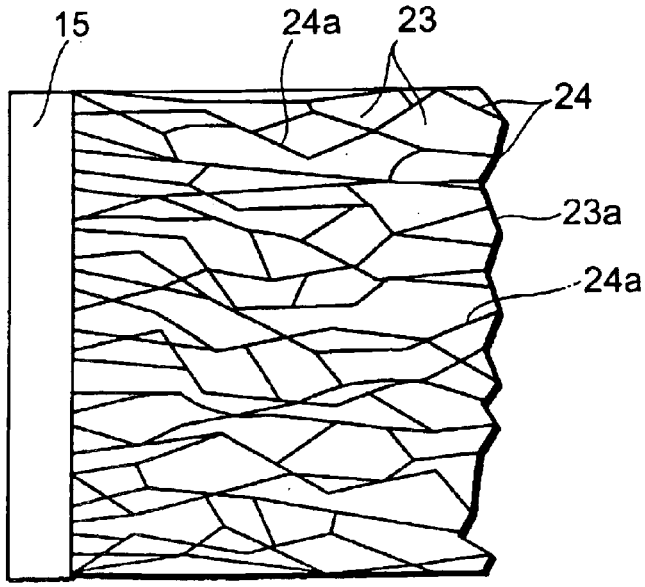
FIG. 3 is a cross section explaining the cold cathode according to the present invention with a magnified portion thereof.

FIG. 3 shows schematically a magnification of a partial cross section of the cold cathode obtained by the above method, where the high quality diamond phases 23 and the graphite phases 24 coexist with each other.

Figure 4:
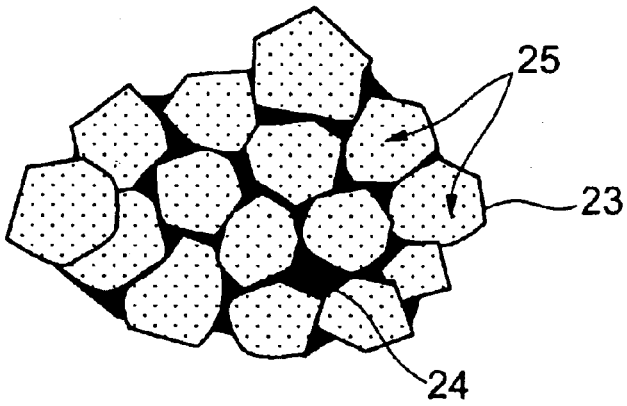
FIG. 4 is a plane diagram of the surface of the cold cathode according to the present invention observed by AFM.

FIG. 4 shows topography and a distribution diagram of conductivity about the surface of the electron emitter having the above structure observed by an atomic force microscope (AFM) using conductive chips. Thus, it can be confirmed by the figure that the conductive regions 24 are dispersed among the diamonds 23.

Figure 5:
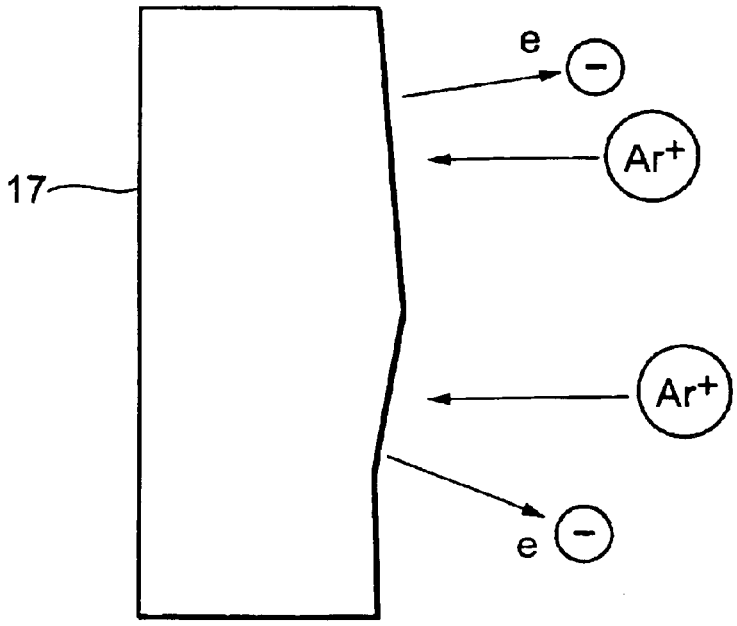
FIG. 5 is a schematic diagram explaining the second electron emission by gamma action.

FIG. 5 shows a schematic diagram of a general mechanism of secondary electron emission by the gamma action. Usually, emission of electrons e from the electron emitter 17 occurs when argon ions ($Ar^+$) collide therewith by means of being accelerated by the electric field as shown in the figure. Efficiency by which electrons pop out of the electrode in this case can substantially be estimated by the work function thereof. On the other hand, because diamond has a negative electron affinity (NEA) or an extremely low electron affinity, there is hardly any emission barrier against $E_{vac}$ in vacuum from the viewpoint of conduction band $E_c$ of the energy band diagram in FIG. 6. Consequently, a high efficiency for secondary electron emission can be obtained by using the diamond although it is carbon system. The diamond phase makes current supply from the supporting member into the diamond smooth, and therefore can effectively emit electrons from the surface of the diamond to space.

Figure 6:
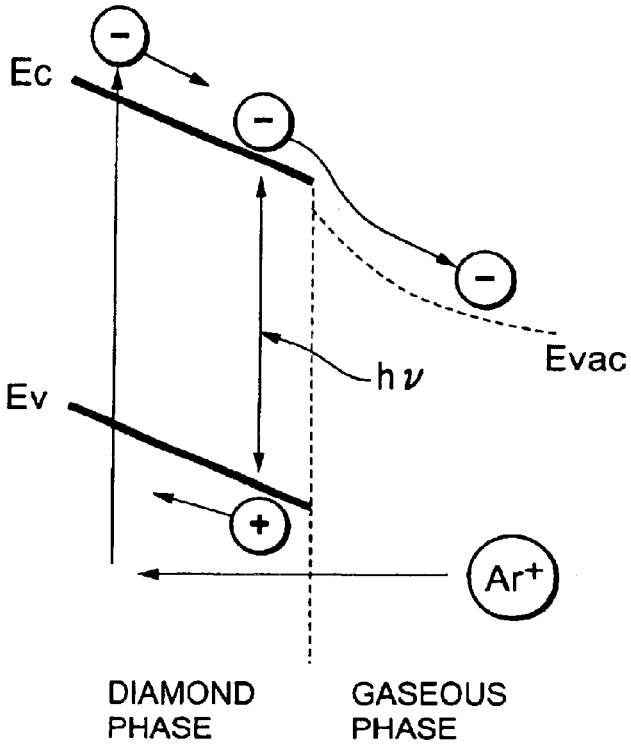
FIG. 6 is an energy band model for electron emission.
Figure 7:
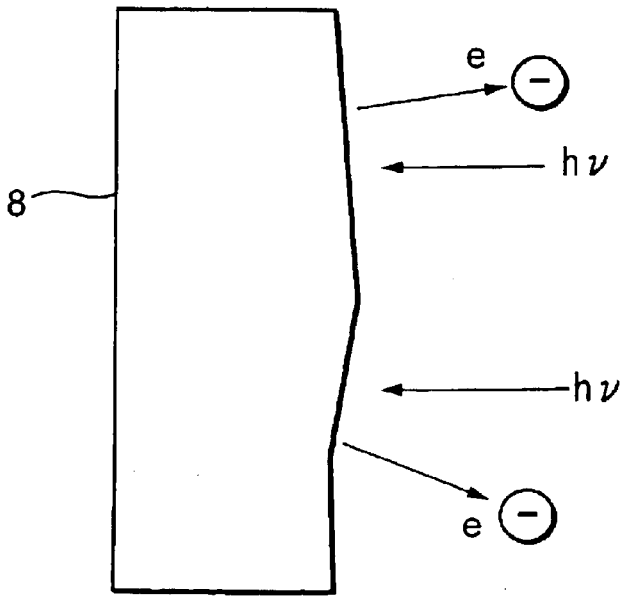
FIG. 7 is schematic diagram explaining secondary electron emission by photo-action.

Furthermore, as shown in FIG. 6 and FIG. 7, the high quality diamond can emit electrons e by means of generating direct transition between energy bands due to light hυ so as to excite carriers. In the present invention, xenon is added to argon and mercury generally used, to utilize the above phenomenon. Thus, far ultraviolet radiation having energy higher than directly excited wavelength of the diamond is generated in the tube, so that it can excite the diamond phase of the cathode and promote formation of carriers. It is desirable for the excitation wavelength to be 200 nanometers or less. The principal radiation spectrum of mercury (Hg) vapor hardly contributes to direct excitation of the diamond, because the spectrum is 230 nanometers. However, xenon gas can effectively excite the diamond phase, because it has the principal intense radiation spectrum equal to or shorter than 200 nanometers.

Figure 8:
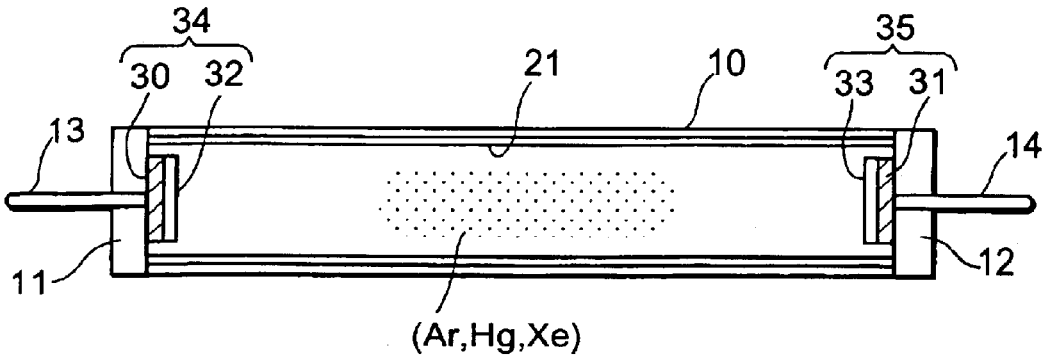
FIG. 8 is a cross section of the second embodiment.
Figure 9:
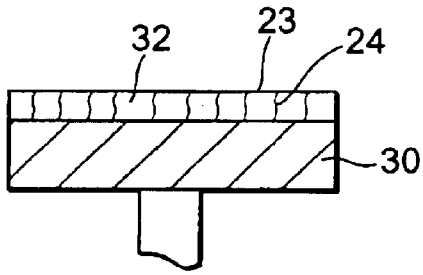
FIG. 9 is a magnification of the main portion of the second embodiment.

FIG. 8 and FIG. 9 show the second embodiment of the present invention. Each part denoted by the same mark as that in FIG. 1 is the same part. The both ends of a tubular envelope 10 of transparent quartz or glass are sealed with stems 11 and 12 through which leads 13 and 14 penetrate hermetically. The portions of the leads protruding inside the envelope are connected with substrates 30 and 31 for the cathode supporting members of metal such as nickel. Layered electron emitters 32 and 33 are formed on the surfaces of the supporting members 30 and 31 so as to construct cold cathodes 34 and 35. A fluorescent film 20 is coated on the inner surface of the envelope, which is filled with a discharge gas of Ar, Hg and Xe at a low pressure. Furthermore, the filled gas may be selected from other rare gases such as neon (Ne).

The electron emitter 32(or 33) is formed as a diamond system layer on the supporting member substrate 30(or 31). The structure reduces volume of the electrode and can make the manufacturing method simple.

In this embodiment, the diamond system layer, which is the cold cathode material, is formed on the substrate 30 as the electron emitter 32 by chemical vapor deposition (CVD). This electron emitter is formed on the substrate as a poly crystalline diamond film, becoming a mixed phase in which amorphous carbon or graphite grain remains at the boundary of the crystal grain. Degree by which the amorphous carbon or the graphite grain remains may suitably be adjusted by the process condition of the film by CVD.

For the material of the substrate, a semiconductor substrate such as silicon (Si) of low resistance, silicon carbide (SiC) and gallium nitride (GaN), or a ceramic substrate covered with a thin film of metal such as copper (Cu), Ni, iron (Fe), and molybdenum (Mo) may be employed as well as metallic materials mentioned above. Besides the above, precious metals like platinum (Pt) or iridium (Ir) can be selected for the metallic thin film.

On the substrate 30 having a surface to which conductivity is given prepared by the above-mentioned method, a film of diamond system material is formed by CVD. Well-known various CVD apparatus such as hot filament CVD, microwave plasma CVD, and DC plasma CVD may be used in the process. For gaseous raw material, methane, acetone, various alcohols, CO, $CO_2$ etc. can be used for carbon source, and hydrogen can be used for environment gas. Oxygen can also be suitably used. Furthermore, formation of electron carrier may be promoted by doping an element such as phosphor or sulfur. Doping boron etc. can reduce resistance.

The standard condition among these is that filming is carried out by a microwave plasma CVD, applying a negative bias voltage to the substrate at 780 degrees Celsius in methane and hydrogen, methane/hydrogen flow ratio being 5%, and pressure being 100 Torr. Thickness of the film can be adjusted optionally by varying the filming condition or filming time. It is desirable to be in the range between approximately 0.5 mm and 1 mm.

As shown in FIG. 4 giving an example of magnification of the surface by AFM, the fine structure of the electron emitter prepared by CVD is a composite structure comprising the crystal particles 23 of diamond and the graphite components 24 having conductive sp2 bonding among the crystal particles. Here the graphite component means widely any non-diamond crystal components having sp2 bonding and conductivity, as well as crystalline one. Moreover, fine conductive regions 25 distribute even inside the diamond crystal particles. The above can be realized, for example, by means of some methods such as increasing methane concentration, or promoting nucleus growing by applying a bias voltage thereto when it is growing, etc. Besides, donor impurities can be included in the diamond components.

Thus the diamond crystal regions 23 and the conductive regions 24 of graphite, etc. distribute adjacently, so that the structure hardly charges up and can easily emit electrons as a whole.

After cutting the filmed substrate obtained in this way into an appropriate size so as to mount in the envelope, a lead terminal is fixed thereto as an electrode by a well-known method such as caulking, brazing, alloy-bonding, screw cramping, etc.

Figure 10:
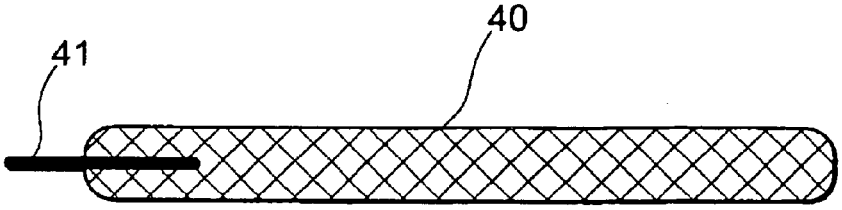
FIG. 10 is a magnification of the main portion of the third embodiment.

FIG. 10 shows the third embodiment of the present invention. The electron emitter 40, which is a mixed phase of diamond phase and amorphous carbon phase, has a lowered resistance and mechanical strength that can support it by itself, so that most portion of the cold cathode can be formed by the electron emitter 40 as shown in the figure and the supporting member can support a part of the emitter to prepare the cold cathode. Therefore, the emitter can withstand wear-out of the electrode, even if it is used for a tiny electrode of a miniaturized discharge lamp. This is advantageous for the lamp to have long life.

As explained by the above embodiments, first of all, improving the efficiency of light emission, which is the problem for the cold cathode discharge lamp, can be achieved according to the present invention, because the diamond has a high efficiency of secondary electron emission thanks to the energy band structure thereof as mentioned above. Especially, efficiency of electron emission can be highly improved by promoting direct excitation of electrons and holes with far ultraviolet rays peculiar to the high quality semiconductor diamond, by means of containing and mixing up some kinds of gases having a high-energy excitation wavelength equal to or greater than the band gap thereof, as well as by means of gamma action by ion bombardment.

Furthermore, diamond alone has some problems that a large potential generates therein because of its high resistance, even if the electric field for electron emission near the surface thereof can be made small, or that a potential as the cathode cannot be applied because the whole thereof is charged up due to its high insulation. The above problems can be compensated by graphite system matrix of the same carbon. Thus an electrode, which has low resistance and does not charge, can be realized. Moreover, metallic grains may be mixed in the conductive carbon, or even substituted for the conductive carbon. Additionally, the conductive carbon may be amorphous carbon.

Besides, as a material for the electrode, carbon system can realize lengthening the life thereof because it has high anti-spattering property as mentioned above. The material is characterized in that positive consumption of mercury does not occur because it cannot be easily spattered and besides spattered material is never amalgamated with mercury. In addition to the above, the carbon system has an advantage that it is friendly to the environment of the earth and is allowed to be burned away after being used.

It is needless to say that the cold cathode in accordance with the present invention can be applied to a display device having a cold cathode and utilizing gas discharge such as a plasma display device (PDP), etc. A common electron emitter for a plurality of pixels as a cold cathode can be prepared on a flat substrate through the structure and the process of the second embodiment. In this case, it acts as a cathode having excellent secondary electron emission by including a gas with a principal radiation spectrum equal to or shorter than 200 nanometers in wavelength such as Xe in the discharge gas.

The cold cathode according to the present invention can realize a discharge device that has a high efficiency compared to conventional cold cathode discharge devices and long life, and is friendly to the environment.

What is claimed is:

1. A cold cathode discharge device used as a discharge lamp, comprising:

an envelope filled with a discharge gas therein;

a fluorescent film coated on an inner surface of the envelope;

a cold cathode comprising a supporting member of conductive material and an electron emitter with an electron-emitting surface configured to emit electrons and supported by the supporting member, the electron emitter being positioned in the envelope; and the discharge gas comprising a rare gas and mercury, wherein the electron emitter comprises a mixed phase of diamond phase and conductive carbon phase, the diamond phase comprises granular bodies doped with at least one element selected from the group consisting of phosphorus, sulfur, and boron, and the conductive carbon phase is formed between the granular bodies and extends in the form of a channel between the supporting member and the electron-emitting surface in the electron emitter.

2. The cold cathode discharge device as stated in claim 1, wherein the discharge gas comprises xenon.

3. The cold cathode discharge device as stated in claim 1, wherein the conductive carbon phase comprises graphite or amorphous carbon layers.

4. The cold cathode discharge device as stated in claim 1, wherein the electron-emitter surface is made rough, and the conductive carbon phase is exposed on the electron emitting surface.

5. The cold cathode discharge device as stated in claim 1, wherein the envelope is an elongated envelope having the supporting member in both end regions thereof.

6. A cold cathode discharge device used as a discharge lamp, comprising:

an envelope filled with a discharge gas therein;

a fluorescent film coated on an inner surface of the envelope;

a cold cathode comprising a supporting member of conductive material and an electron emitter with an electron-emitting surface configured to emit electrons and supported by the supporting member, the electron emitter being positioned in the envelope; and the discharge gas comprises a gas including an element with a principal radiation peak of 200 nanometers or less in wavelength, wherein the electron emitter comprises a mixed phase of diamond phase and conductive carbon phase, the diamond phase comprises granular bodies doped with at least one element selected from the group consisting phosphorus, sulfur, and boron, and the conductive carbon phase is formed between the granular bodies and extends in the form of a channel between the supporting member and the electron-emitting surface in the electron emitter.

7. The cold cathode discharge device as stated in claim 6, wherein the discharge gas comprises xenon.

8. The cold cathode discharge device as stated in claim 6, wherein the conductive carbon phase comprises graphite or amorphous carbon layers.

9. The cold cathode discharge device as stated in claim 6, wherein the electron-emitting surface is made rough, and the conductive carbon phase is exposed on the electron emitting surface.

10. The cold cathode discharge device as stated in claim 6, wherein the envelope is an elongated envelope having the supporting member in both end regions thereof.

* * * * *